US006122920A

United States Patent [19]

Hill et al.

[11] Patent Number: 6,122,920

[45] Date of Patent: Sep. 26, 2000

[54] HIGH SPECIFIC SURFACE AREA AEROGEL CRYOADSORBER FOR VACUUM PUMPING APPLICATIONS

[75] Inventors: Randal M. Hill, Livermore; Eric R. Fought, Brentwood; Peter J. Biltoft, Livermore, all of Calif.

[73] Assignee: The United States of America as represented by the United States Department of Energy, Washington, D.C.

[21] Appl. No.: 09/218,034

[22] Filed: Dec. 22, 1998

[51] Int. Cl.[7] ..... B01D 8/00

[52] U.S. Cl. ..... 62/55.5; 62/51.1

[58] Field of Search ..... 62/55.5, 50.6, 62/51.1, 45.1, 46.1, 46.3

[56] References Cited

U.S. PATENT DOCUMENTS 5,386,706 2/1995 Bergsten et al. ..... 62/45.1

*Primary Examiner*—William Doerrler

*Attorney, Agent, or Firm*—William C. Daubenspeck; William R. Moser; Paul A. Gottlieb

[57] ABSTRACT

A cryogenic pumping system is provided, comprising a vacuum environment, an aerogel sorbent formed from a carbon aerogel disposed within the vacuum environment, and cooling means for cooling the aerogel sorbent sufficiently to adsorb molecules from the vacuum environment onto the aerogel sorbent. Embodiments of the invention include a liquid refrigerant cryosorption pump, a cryopanel and a Meissner coil, each of which uses carbon aerogel as a sorbent material.

18 Claims, 6 Drawing Sheets

HIGH SPECIFIC SURFACE AREA AEROGEL CRYOADSORBER FOR VACUUM PUMPING APPLICATIONS

The United States Government has rights in this invention pursuant to Contract No. W-7405-ENG-48 between the United States Department of Energy and the University of California.

This invention relates to cryosorbent materials used to adsorb gases, as can be found in devices including liquid refrigerant cryosorption pumps, compressed helium cryogenic pumps, cryopanels and Meissner coils.

BACKGROUND OF THE INVENTION

Cryogenic pumps use the inherent physical force of dispersion to remove gas atoms or molecules from active circulation within a system. The dispersion force causes neutral gas atoms or molecules striking a sufficiently cooled surface to bond with the surface, removing them from the environment surrounding the cooled surface for a mean residence time before the atoms or molecules break free. When a gas atom or molecule sticks to a cooled surface in this fashion, it is said to be "adsorbed." If the mean residence time during which it is adsorbed is sufficiently long to serve the purposes of a cryogenic pump, the molecule is said to be "pumped."

By pumping atoms and molecules and thus removing them from the surrounding environment, cryogenic pumps can be used to create vacuums which can be used in vacuum systems ranging from general purpose vacuum systems to ultra high vacuum systems. Cryogenic pumps are used in a wide variety of applications, including: particle accelerators, thin film deposition, evaporation applications, ion implantation, and the creation of simulated space environments.

The duration of the mean residence time for any particular gas upon the sorbent is dependent upon the temperature: the cooler the sorbent, the longer the residence time. Further, certain gases can only be adsorbed at extremely low temperatures. Accordingly, efficient cryogenic pumping systems operate at extremely low temperatures such as 70 Kelvin or 15 Kelvin.

The amount of gas which a particular cryogenic pump can effectively remove from a system is limited. A cooled surface acting as a sorbent has a limited number of adsorption sites. The process of adsorption is continuous, as previously-adsorbed atoms and molecules break away from the sorbent and are replaced by newly adsorbed atoms and molecules. Early in the adsorption process, many adsorption sites are open, and the rate at which atoms and molecules are adsorbed greatly exceeds the rate at which they break away from the sorbent. Later in the adsorption process, few unused adsorption sites remain, and rate at which atoms and molecules break free from the sorbent becomes approximately equal to the rate of adsorption. At this point, the sorbent is said to be saturated.

Once the sorbent is saturated, no further net gains in pumping can occur until the already-pumped gases are desorbed from the sorbent. Traditionally, to enable further pumping, the sorbent is removed from the pump and heated until the adsorbed molecules are effectively "baked" out of the sorbent in a process called regeneration. Following regeneration, the sorbent is recooled and cryopumping is again possible. For each regeneration the sorbent must be removed from the pumping system and baked; this adds time and complexity to the pumping process. The capacity and thermal conductivity of the sorbent are the primary characteristics controlling this "bakeout" time.

Accordingly, the choice of a sorbent material for a cryopump is critical. Some cryopumps such as cryopanels and Meissner coils adsorb gases on their cooled outer metallic surfaces. As metals are not highly effective sorbents, these pumps' ability to pump gases are non-optimal for the temperatures achieved.

State of the art sorbent choices for cryopumps include coconut charcoal and synthetic zeolites, which have become standard sorbents for cryogenic vacuum pumping applications. Synthetic zeolites are used, for example, in liquid refrigerant cryosorption pumps and are formed in pellets usually one to two millimeters in diameter. These pellets are disposed within a pump volume with point-to-point contact between the pellets and the walls of the pump chamber. Coconut charcoal is used, for example, in compressed helium cryogenic pumps. It is produced by burning coconut husk and is formed in small, randomly-shaped chunks which are usually bonded to a nickel plated copper substrate with a thermally conductive epoxy adhesive. Both are desirable sorbents because of their relatively high surface areas.

However, the random shape of coconut charcoal and the pellet shape of synthetic zeolites reduce their effectiveness as sorbents. Because of their thickness, adsorption sites in the inner cores of these sorbents remain largely inaccessible to atoms or molecules in the pumping environment even after the outer surface of these sorbents are fully saturated. Adsorption sites in the inner core are used only when atoms or molecules previously adsorbed on the outer surface of the sorbent work inward upon desorption. It can take numerous adsorption-desorption steps for an atom or molecule to reach adsorption sites in the inner core. Overall, this reduces the effective surface area per volume of these sorbents, reducing the capacity per volume of the cryopump.

The shape of these sorbents also limits the degree of thermal conductivity achievable between the pumping mechanism and the sorbents. Synthetic zeolite, which is a ceramic, naturally has poor thermal conductivity. The time for thermal energy to pass between the zeolite pellets by point-to-point contact is extensive. For the coconut charcoal, the thermal bond between the nickel-plated copper and the sorbent is poor due to the irregular geometry of the coconut and the limited thermal conductivity of the epoxy bonding agent. The epoxy used with coconut charcoal further limits the temperatures at which the pump may be heated during regeneration, as typical epoxies will soften at high temperatures.

The poor thermal conductivity to these sorbents increases the amount of time necessary both to cool the sorbents initially during pumping, and to bake the sorbent to desorb the accumulated gases and regenerate the pump. One such baking/cooling cycle alone may take multiple hours. Particularly in applications requiring a large number of cryopumps, such as linear accelerators, the extended bakeout times increase operating costs, making it necessary to include many redundant cryopumps to ensure continuous pumping, and require large numbers of personnel to oversee the regeneration of the pumps.

Additionally, these sorbents, particularly synthetic zeolites, are friable and produce dust which can be swept into a clean vacuum system during the turbulent flow that occurs at the onset of evacuation of the system. This can contaminate ultra-high vacuum experiments, and cause purge values to malfunction. Coconut charcoal and synthetic zeolites are not used in simpler cryopumping devices such as cryopanels and Meissner coils both for this reason, and because of the relatively high degree of effort necessary to attach a multitude of sorbent particles to the outer surface of the device.

It is an object of the current invention to provide a sorbent for a cryopump which has a large pumping capacity and also offers improved thermal conductivity and flexibility of design.

It is a further object of the current invention to provide a sorbent for a cryopump which can be resistively heated to produce rapid desorption of gases and thus rapid regeneration of a cryopump.

Another object of the current invention is to provide a sorbent for a cryopump which is non-friable and minimizes the risk of dust corruption of the vacuum produced by the cryopump.

Other objects and advantages of the current invention will become apparent when the carbon aerogel sorbent of the current invention is considered in conjunction with the accompanying drawings, specification, and claims.

SUMMARY OF THE INVENTION

A cryogenic pumping system is provided, comprising a vacuum environment, an aerogel sorbent formed from a carbon aerogel disposed within the vacuum environment, and cooling means for cooling the aerogel sorbent sufficiently to adsorb molecules from the vacuum environment onto the aerogel sorbent. Further embodiments of the invention include a liquid refrigerant cryosorption pump, a compressed helium cryogenic pump, a cryopanel and a Meissner coil, each of which uses carbon aerogel as a sorbent material.

DESCRIPTION OF THE PREFERRED EMBODIMENT

The current invention replaces the sorbents used in the current state of the art with a sorbent formed from a carbon aerogel. Carbon aerogels have an extremely high surface area, from 400 to 1000 $m^3/g$, providing ample adsorption sites. These aerogels can be formed as films as thin as from 1 to 10 micrometers, and can be shaped to irregular geometries. Carbon aerogels can be produced which provide good thermal conductivity relative to coconut charcoal and zeolites, and the thermal conductivity of the aerogel can be increased by forming aerogel/metal composites, such as by partially metallizing the surface of the aerogel panel by sputtering or electroplating metal layers onto the aerogel surfaces, or by growing the aerogels upon a metal mesh or foil. Composite carbon aerogels can be produced which are non-friable and thus do not produce dust which may contaminate the vacuum produced by the cryopump. Carbon aerogels are produced commercially and can be obtained from suppliers such as Ocellus, Inc. of Alameda, Calif.

A. Liquid Refrigerant Cryosorption Pump

Figure 1:
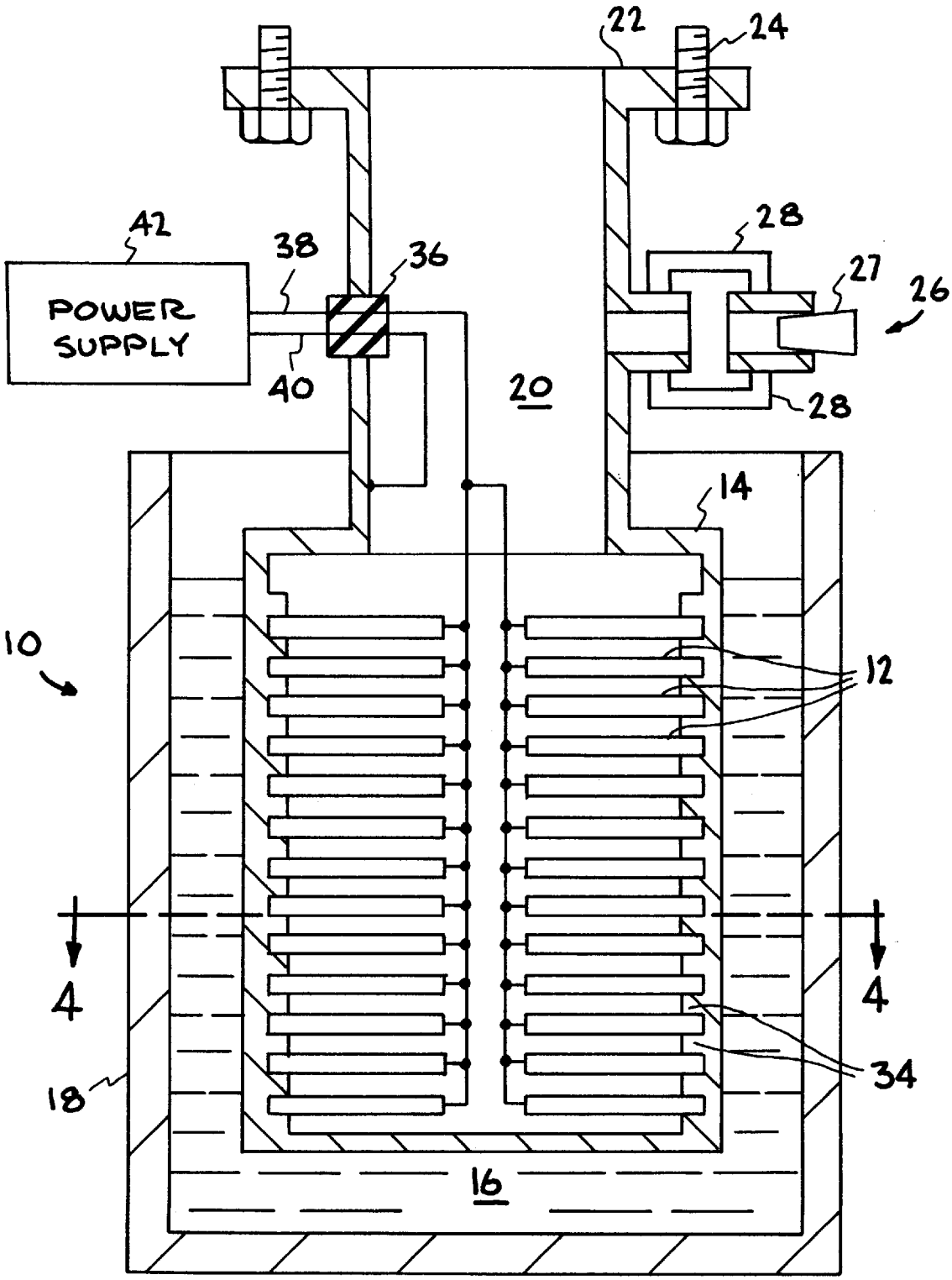
FIG. 1 is a side plan view of an inventive liquid refrigerant cryosorption pump.

FIG. 1 depicts an inventive liquid refrigerant cryosorption pump 10 using carbon aerogel as a sorbent material. Pumping takes place within a container 14 having a set of carbon aerogel panels 12 fixed to its inner surface. Container 14 can be detachably connected to a system to be pumped at flange 22 using bolts 24. During pumping, the container 14 is immersed within a bath of a liquid refrigerant 16, such as liquid nitrogen, contained within a dewar 18. The refrigerant 16 cools both the container and, by thermal conduction, the carbon aerogel panels 12. Container 14 is typically made from a conductive metal such as aluminum to facilitate thermal conduction. As the carbon aerogel panels 12 cool, gases in the container volume 20 are adsorbed by the panels 12. At the temperature of liquid nitrogen (about 77 Kelvin) adsorption of all gases other than hydrogen, helium and neon will take place.

Once the panels 12 become saturated, the container 14 is typically removed from the liquid refrigerant 16 and isolated from the pumping environment, as by physically detaching the container 14 from the pumping environment or closing a valve (not shown) used to isolate the container 14 from the pumping environment. Panels 12 are then heated to regenerate the pump 10, preferably by resistively heating panels 12 as will be described below. As regeneration proceeds and gases are released from the carbon aerogel panels, pressure will build up in the container 14 if it has not been completely physically detached from the environment to be pumped, e.g., if a valve isolating the pumping environment from the liquid refrigerant cryosorption pump has been closed. Accordingly, a pressure relief valve 26 is provided which allows purged gases to evacuate the container 14 as pump regeneration proceeds. Valve 26 preferably uses a Viton™ stopper 27 and cuffs 28, as Viton™ is very low out-gassing, resistant to temperature excursion, and does not pyrolize below 200 degrees Centigrade.

In a preferred embodiment, carbon aerogel panels 12 comprise composite aerogel/metal sheets. Composite aerogel/metal sheets have extremely high conductivity, can be easily fastened to the inner wall of container 14 with good thermal conductivity between each panel 12 and the container 14, and are strong and resistant to breakage. The substantial increase in thermal conductivity between the metal container 14 and composite aerogel/metal panels 12 over typically used sorbents such as synthetic zeolite, and even over non-composite aerogel panels, reduces the time needed to cool down the sorbent during pumping and heat the sorbent during pump regeneration.

Panels 12 can be heated indirectly through thermal conduction by heating container 14, using methods including but not limited to baking. However, composite aerogel/metal panels 12 can be heated resistively by flowing electrical current through the composite. For example, an electrical feed through 36 may be provided for container 14 to which leads 38 and 40 extending from a standard AC or DC power supply 40 can be attached. One lead 38 may be fixed to the metal container 14, which is directly fixed to one side of each metal composite panel 12, while the other lead may be fixed to the opposing edges of the metal composite panels 12. Once power is supplied from the power supply 40, current will run through each panel 12, resistively heating the panel 12. Such resistance heating is less expensive and more efficient than the baking process required to desorb gases from sorbents such as synthetic zeolite or coconut charcoal, and allows regeneration of the cryosorption pump in minimal time.

Figure 2:
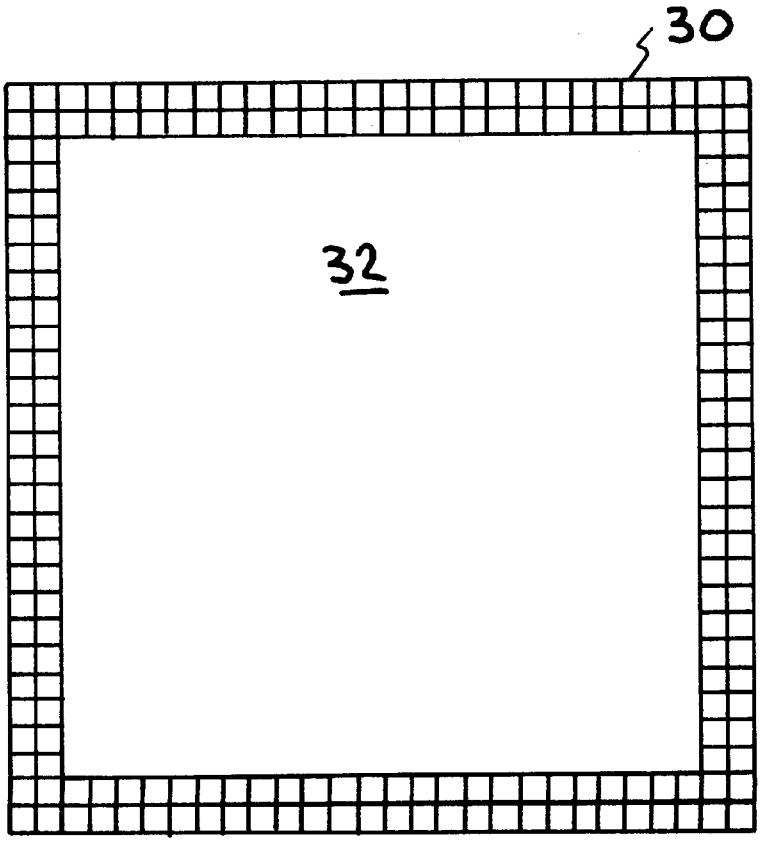
FIG. 2 is a top plan view of an inventive carbon aerogel panel comprising a metal mesh upon which carbon aerogel is grown.

Composite aerogel/metal sheets include, but are not limited to, sheets of carbon aerogel having metallized outer surfaces, or sheets of metal mesh 30 or foil upon which a film of carbon aerogel 32 has been grown, as shown in FIG. 2.

Figure 3:
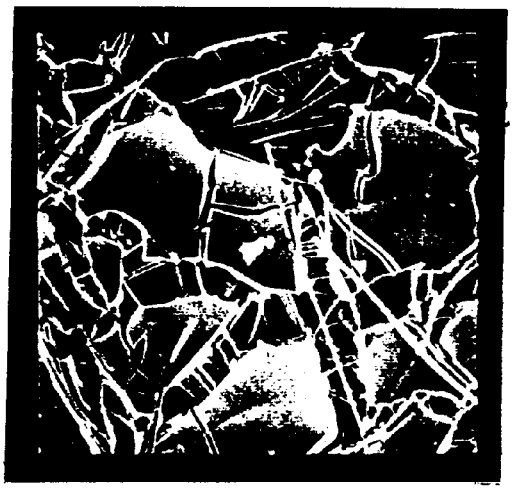
FIG. 3 is a scanning electron micrograph (SEM) of carbon aerogel on a carbon fiber matrix.

It should be noted that panels 12 can be formed solely from carbon aerogel or from non-metallic carbon aerogel composites, including but not limited to growths of carbon aerogel films upon carbon fibers. FIG. 3 shows a scanning electron micrograph of carbon aerogel on a carbon fiber matrix.

Where panels 12 comprise carbon aerogel embedded upon a metal mesh or foil, the metal mesh or foil can be directly welded to the inner wall of the container 14. Alternative panel 12 embodiments not incorporating metal structures can be fixed to the inner wall of the container 14 by any appropriate means, including sandwiching an edge of the panel 12 between support members extruded from the wall such as ridges 34. Even non-composite aerogel panels 12 are rigid and will not require supporting structures to be maintained in a cantilevered position.

Figure 4:
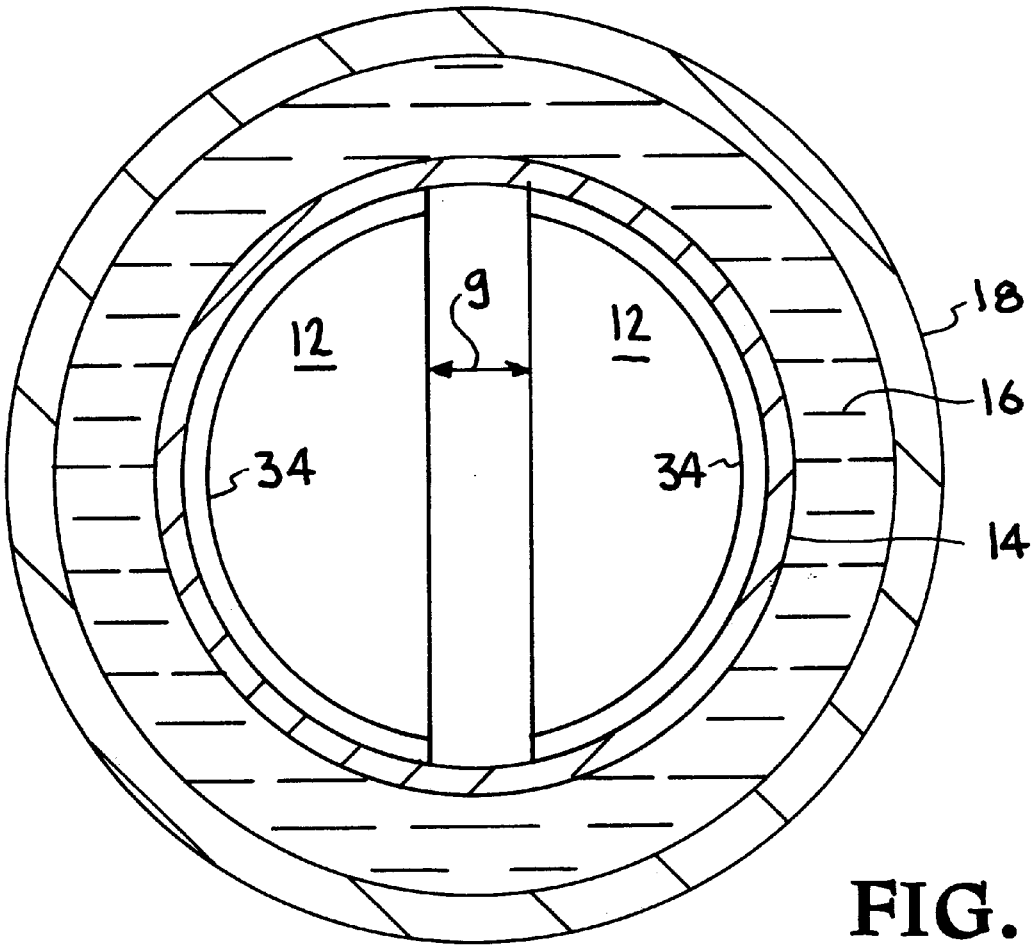
FIG. 4 is a cross-section view of the inventive liquid refrigerant cryosorption pump of FIG. 1 taken at section line 4—4.
Figure 5:
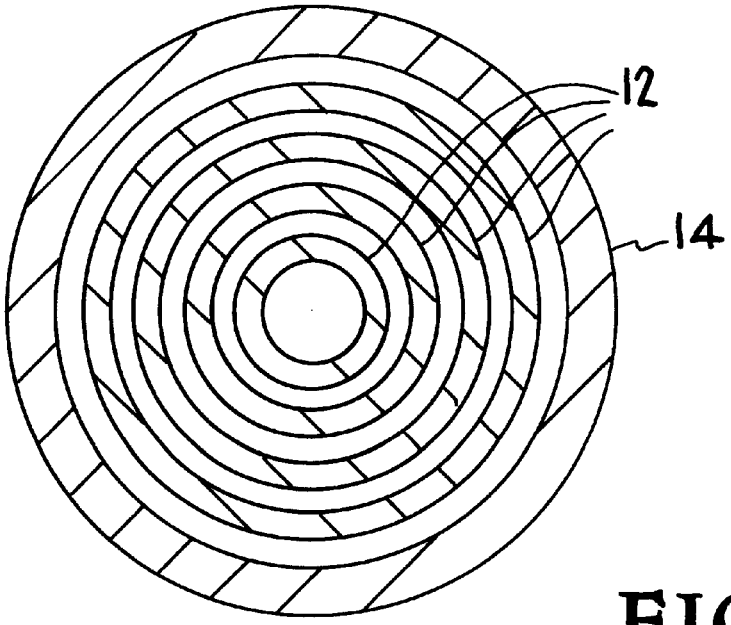
FIG. 5 is a cross-sectional plan view of an inventive liquid cryosorption pump using an alternative carbon aerogel panel arrangement.

Panels 12 can be shaped and arranged within container 14 in a wide variety of ways. In a preferred embodiment used with cylindrical containers 14, shown in FIG. 4, pairs of opposing semicircular panels 12 are layered from the bottom to the top of the container 14, with a small gap g between opposing panels 12. Such panels 12 have large upper and lower surface areas, and gap g allows the gas of the container volume 20 full access to both the upper and lower surfaces of each panel 12. However, any panel configuration can be used; preferably, any embodiment will maximize the panel surface area exposed to the container volume 20. For example, in an alternative embodiment panels 12 comprise a set of concentric cylinders fixed to the bottom of container 14 (see FIG. 5) and extending upwardly to just below the neck of cylinder 14, so that the entire inner and outer surfaces of the concentric cylinders are exposed to the container volume 20.

Panels 12 are preferably made very thin to maximize the number of panels 12 which can be fitted within the container volume 20. Current manufacturing techniques allow carbon aerogel to be bonded onto metal mesh or foil with a thickness of approximately 0.05 inches, and carbon aerogel films can be formed upon a carbon fiber matrix with a resulting thickness of approximately 0.01 inches. As most of the adsorption taking place in a sorbent occurs on its surface, a thick panel 12 will have a smaller capacity per volume than will a thin panel 12. Accordingly, by using a larger number of smaller panels, the capacity of the pump can be substantially increased. By thereby increasing pump capacity per volume, the inventive carbon aerogel sorbent will allow a user to miniaturize cryosorption pumps without loss of function, or obtain greater capacity in an equally sized pump. It should be noted that the carbon aerogel panels 12 shown mounted within container 14 in FIG. 3 are drawn with substantial thickness for clarity and ease of illustration; in actual construction, many more panels 12 can be fitted within a container of the shown size.

Further, because the aerogel panels are spaced apart from each other within container 14, no screens are necessary to provide access to the carbon aerogel sorbent, as are needed when using loose quantities of synthetic zeolite. Because a screen is unnecessary, a larger proportion of the volume 20 of container 14 can be used to hold panels 12, and accordingly the pump capacity can be further increased.

B. Compressed Helium Cryogenic Pump

Another cryopump in which the inventive aerogel sorbent can be used is a compressed helium cryogenic pump. Compressed helium cryogenic pumps supply extremely low temperatures (in the range of between 10 to 20 Kelvin) for adsorption of gases such as hydrogen, helium, and neon, using gaseous helium. The helium is compressed, gaining heat from the compression which is removed by forced cooling. After the compressed helium has cooled, it is allowed to expand into a displacer. The expansion of the helium further cools the helium, producing extremely low temperatures. Such helium refrigerators usually use several "stages" at which the temperature of the gaseous helium is lowered in steps.

Figure 6:
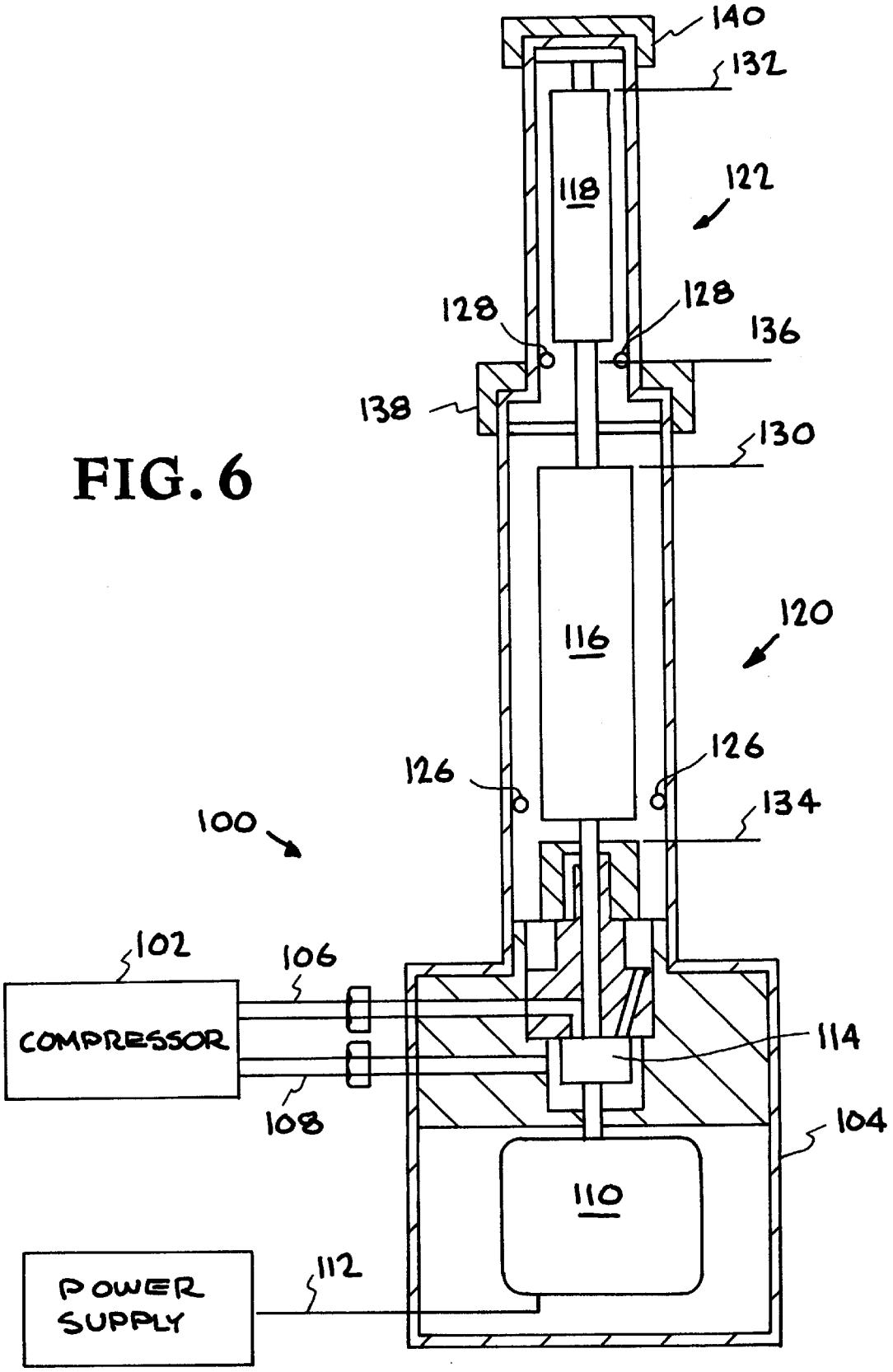
FIG. 6 is a side elevation view of a two-stage compressed helium refrigerator used in an inventive compressed helium cryogenic pump.

FIG. 6 depicts a two-stage compressed helium refrigerator 100. Helium gas is compressed and slightly cooled using a water-based heat exchanger in compressor 102. Compressor 102 delivers compressed and cooled helium gas to cold head 104 at a high pressure (typically 300 psi) through a high pressure compressed helium supply line 106. Helium gas is returned at low pressure (typically 80 psi) to compressor 102 from cold head 104 through a low pressure compressed helium return line 108. Motor 110, which is powered from a power source through a power supply line 112, serves to rotate a valve disc 114 which is ported to control the flow of high pressure helium into cold head 104 and low pressure helium from cold head 104 during pumping.

Motor 110 also controls displacement of two regenerator pistons 116 and 118 which cause the refrigeration of the helium gas. First stage regenerator piston 116 is disposed within the first stage 120, and second stage regenerator piston 118 is disposed within the second stage 122. Regenerator pistons 116 and 118 are made of a material having high heat capacity which is tightly packed but which does not seriously impede gas flow. Typical materials used to construct pistons 116 and 118 include, but are not limited to, lead or copper spheres. First stage 120 is sealed with seals 126, and second stage 122 is sealed with seals 128.

In operation, when pistons 116 and 118 are at the respective positions 130 and 132, valve disc 114 is used to open the helium supply line 106, allowing the compressed helium gas delivered from the compressor 102 to enter the first stage 120. As the supply of compressed helium gas supply from the compressor 102 is continued, pistons 116 and 118 are moved by motor 110 towards the respective positions 134 and 136, drawing helium gas through pistons 116 and 118 towards heat loads 138 and 140. Note that if the pump has already undergone prior cooling cycles, most of the helium gas drawn towards heat load 140 in second stage 122 will consist of already-cooled helium gas. Once pistons 116 and 118 reach positions 134 and 136, valve disc 114 is operated to close the compressed helium supply line 106 and open the helium return line 108. As the return line 108 is at lower pressure than the compressed helium gas (80 psi rather than 300 psi), the helium gas cools as some of the helium gas expands back into return line 108. While the return line 108 remains open, pistons 116 and 118 are then returned to positions 130 and 132, forcing more helium gas into the return line 108 and preparing the refrigerator 100 for a new cooling cycle. The return line 108 is then closed, with a portion of the cooled helium gas remaining in refrigerator 100.

By repeating this process, first stage 120 will typically be cooled to between 50 and 80 Kelvin. Because most of the helium gas circulated through second stage 122 by the movements of pistons 116 and 118 has already been cooled in the first stage 120, second stage 122 attains cooler temperatures, in the range of 10 to 20 Kelvin.

Figure 7:
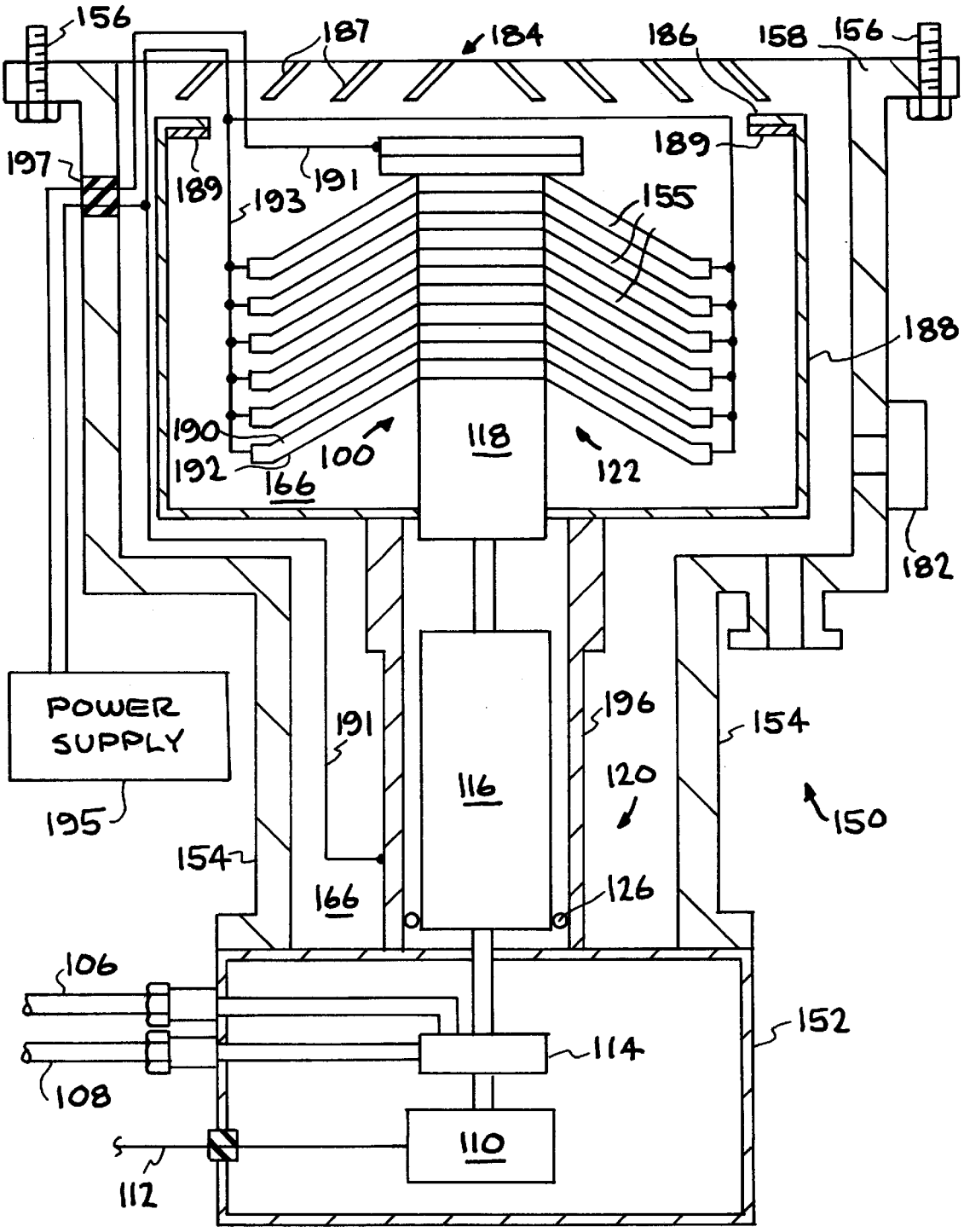
FIG. 7 is a side elevation view of an inventive compressed helium cryogenic pump.

FIG. 7 depicts an inventive compressed helium cryogenic pump 150 using the two-stage compressed helium refrigerator 100 described above with a carbon aerogel sorbent to provide improved vacuum pumping. The motor 110, supply and return lines 106 and 108, power supply line 112, and valve disc 114 can all be fitted within a housing 152. The first and second stages 120 and 122 of the refrigerator 110 are housed within a pumping chamber defined by walls 154. An array of carbon aerogel panels 155 are secured to the outer surface of the second stage 122, and serve as the primary sorbent material for the compressed helium cryogenic pump 150, as will be described in more detail below.

Figure 8:
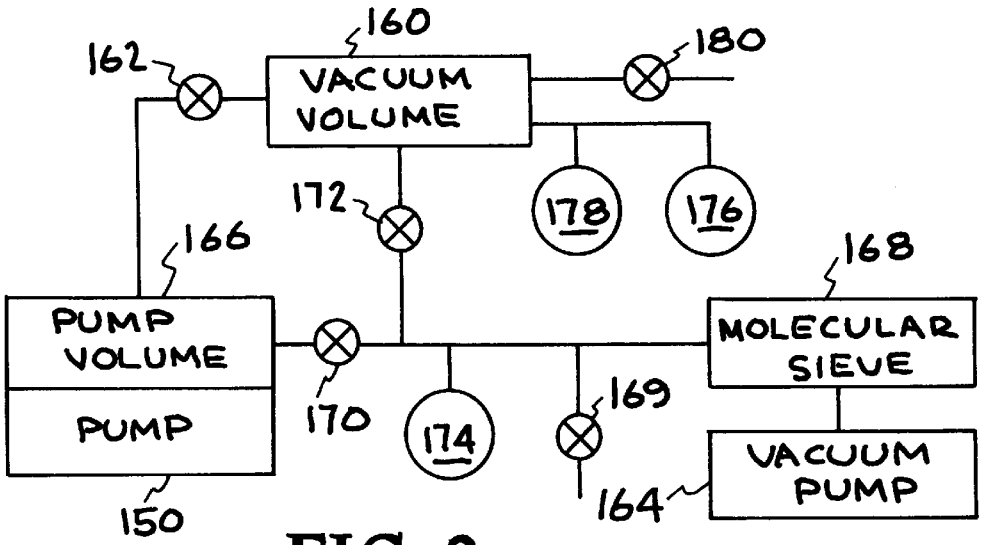
FIG. 8 is a diagram showing the components used in pumping a vacuum vessel with the inventive compressed helium cryogenic pump of FIG. 7.

Referring to FIG. 8, during pumping, the vacuum vessel 160 to be pumped is connected to the pump 150 through a valve 162, which may be sealed to pump 150 using suitable securing means such as bolts 156 extended through flanges 158 (see FIG. 7). Before operation of the pump, while valve 162 is closed, a mechanical pump 164 is used to evacuate the pump volume 166 and the vacuum volume 167 to approximately $10^{-3}$ Torr. A molecular sieve 168 prevents oil from the mechanical pump from entering the pump volume 166 or vacuum volume 167. The mechanical pump 164 is vented through vent valve 169. Valves 170 and 172 isolate the molecular sieve 168 and mechanical pump 164 from the pump volume 166 and vacuum volume 167. Thermocouple gauges 174 and 176 are coupled to the pump volume 166 and vacuum volume 167 which measure the pressures in those volumes from atmospheric pressure to approximately $10^{-3}$ Torr. (Note that thermocouple gauges measure the thermal conductivity of gas in these volumes, from which the pressure within the volume can be directly calculated). An ionization gauge 178 is connected to the vacuum vessel 167 to measure pressures in the vacuum vessel below $10^{-4}$ Torr. Air may be readmitted into vacuum volume 167 after pumping using vent valve 180. Referring back to FIG. 7, air may be readmitted into pump volume 166 after pumping using vent valve 182.

During pumping, valve 162 is opened and gases in vacuum volume 167 pass freely into pump volume 166 through pump inlet 184. An optically opaque condensing array 186 is secured in the pump inlet and thermally coupled to a radiation shield 188, which in turn is thermally coupled to the refrigerator 100 at the junction between the first stage 120 and second stage 122. The individual chevrons 187 forming the condensing array 186 are typically connected to each other in radial fashion by flanges (not shown). Sections of indium foil 189 may be secured at the junctions between the condensing array 186 and the radiation shield 188 and between the radiation shield 188 and the refrigerator 100 to improve the thermal conductivity at those junctions. The radiation shield 188 and condensing array 186 both act to shield the second stage from radiation, preventing temperature increases due to radiation loads. Further, the condensing array 186, which is maintained at a temperature in the range of between 50 and 80 Kelvin, will condense water vapor on its surface. This removes most of the water vapor from the pumping system before it condenses upon the carbon aerogel panels 155, thus keeping the panels 155 free for adsorption of other gases such as oxygen, nitrogen, and the non-condenseable gases, helium, hydrogen, and neon.

The primary adsorption of gases from pump volume 166 and vacuum volume 167 takes place on carbon aerogel panels 155. Carbon aerogel panels 155 may be fixed to second stage 122 in any fashion which provides good thermal conductivity between the panels 155 and the second stage 155. While carbon aerogel panels 155 can take any of the forms described above for the liquid refrigerant cryosorption pump, preferably, composite aerogel/metal sheets are used, such as sheets of metal mesh 30 upon which carbon aerogel is grown, and are welded to the outer surface of second stage 155. The metal in the composite increases the thermal conductivity of the panels 155 and allows the panels 155 to be quickly and easily heated during regeneration using resistive heating. Suitably secured carbon aerogel panels 155 will achieve temperatures in the range of 10 to 20 Kelvin.

In a preferred embodiment, carbon aerogel panels 155 comprise thin circular disks fixed encircling the second stage 122 in cantilevered fashion. The disks may slope downwardly from the pump inlet 184 to increase initial adsorption on the upper side 190 of each disk, preserving adsorption capacity on the lower side 192 of each disk for adsorption of the non-condensable gases, helium, hydrogen, and neon. However, it should be understood that carbon aerogel panels 155 can be configured as desired as long as they retain high thermal conductivity with the second stage 122 and are exposed to gases in pump volume 166.

It should be understood that a similar configuration of carbon aerogel panels 155 can also be fixed about first stage 120. For example, in the embodiment shown in FIG. 7, a panel 196 of carbon aerogel grown on metal mesh is welded about the outer surface of first stage 120, and will attain temperatures in the range of between 50 and 80 Kelvin. Panel 196 will adsorb gases passing around radiation shield 188 into the portion of pump volume 166 surrounding first stage 120.

Panels 155 can be spaced together much more closely than can conventional cryopanels to which bulky sorbent materials such as coconut charcoal are bonded by an adhesive. This allows many more panels, and accordingly a much larger quantity of sorbent, to be fixed about each stage 120 and 122 of the pump 150, increasing the capacity of the pump 150 per volume. As the aerogel panels 155 can be made very thin, as described above in relation to liquid refrigerant cryosorption pumps, the ratio of useful surface area for adsorption to volume for each panel is very high, allowing each panel 155 to adsorb and hold large quantities of gas for long time periods before regeneration of the panel 155 becomes necessary.

Because thermal conductivity between each stage and the carbon aerogel panels is much better than the thermal conductivity to the coconut charcoal of conventional cryopanels, pumping can be achieved more quickly. During regeneration of the carbon aerogel panels 155, heating can be done very rapidly and inexpensively using direct resistance heating produced by running a current through the panels 155. Leads 191 and 193 can be connected from a standard AC or DC power supply 195 through an electrical feed through 197 fitted in the pumping chamber wall 154. To heat panels 155, one lead 191 may be fixed to the outer metal surface of the compressed helium refrigerator 100 to which one edge of each metal composite panel 155 is fixed, while the other lead 193 is fixed to each opposing edge of the panels 155 in parallel. When power is supplied to the leads 191 and 193 by power supply 195, current will flow through each panel 155, resistively heating the panels 155. Lead 193 may also be attached to panel 196, causing current to flow through panel 196 and the metal outer surface of compressed helium refrigerator 100, resistively heating both panel 196 and refrigerator 100.

Pumping Using Cryopanels and/or Meissner Coils

Cryopanels and Meissner coils are simple cryogenic pumps typically used to produce a rough vacuum within a large vacuum vessel. Each comprises a body into which a liquid refrigerant such as liquid nitrogen is constantly supplied. As the liquid refrigerant gains heat it becomes a gas and escapes through an exit vent. The constant supply of liquid refrigerant cools the outer surface of the cryopanel or Meissner coil body. When the cryopanel or Meissner coil is positioned within the vacuum vessel, gases within the vessel are adsorbed upon its outer surface. Both cryopanels and Meissner coils operate in the same manner: the term "Meissner coil" has been reserved to denote cryopanels having coiled bodies. While a cryopanel can have any shape as long as the cryopanel has a hollow interior capable of holding a liquid refrigerant, a typical cryopanel will be formed as a tube or as a flat sheet for ease of manufacture.

While standard cryopanels and Meissner coils work by condensing gases upon their metal outer surfaces, the inventive cryopanel and Meissner coil provide more effective pumping by encasing these metal outer surfaces with carbon aerogel. Carbon aerogel has a much higher specific surface area than does the metal surfaces, and provides more adsorption sites per unit area.

Figure 9:
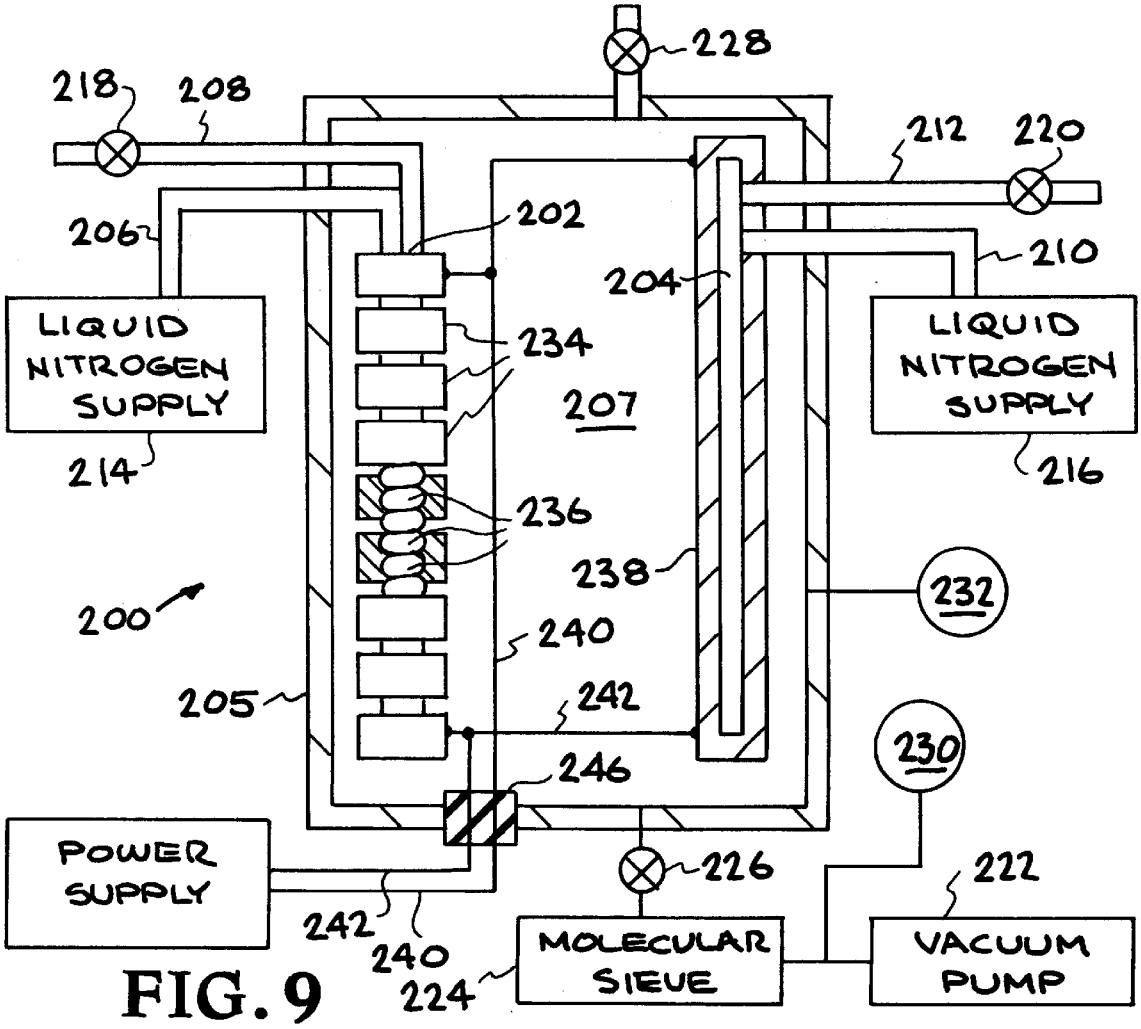
FIG. 9 is a top plan view of a vacuum vessel pumped by an inventive carbon aerogel-covered cryopanel and Meissner coil.

FIG. 9 depicts a preferred embodiment of a vacuum system 200 which uses carbon aerogel sorbents formed on the outer surfaces of a Meissner coil 202 and a tubular cryopanel 204 to adsorb gases in a vacuum vessel 205. Meissner coil 202 has an inlet 206 and an outlet 208 and cryopanel 204 has an inlet 210 and an outlet 212, each of which passes through a sealed aperture in vacuum vessel 205. Liquid nitrogen is supplied to Meissner coil 202 through inlet 206 from liquid nitrogen supply 214 and to cryopanel 204 through inlet 210 from liquid nitrogen supply 216. (Note that inlets 206 and 210 can also be configured to supply helium from a single liquid nitrogen supply). Gaseous nitrogen boiling off of the liquid nitrogen escapes from the Meissner coil 202 through outlet 208 and vents to the atmosphere through vent valve 218, and from the cryopanel 204 through outlet 212 and vent valve 220.

In operation, pressure within the vacuum vessel is initially reduced to approximately $10^{-3}$ Torr using a mechanical pump 222. A molecular sieve 224 prevents oil from the mechanical pump 222 from entering the vacuum vessel volume 207, and valve 226 isolates the mechanical pump 222 and molecular sieve 224 from vacuum vessel volume 207. Vent valve 228 vents vacuum vessel so that air can be reintroduced into vacuum vessel volume 207 after pumping. A thermocouple gauge 230 is provided to measure pressure in the vacuum vessel volume 207 from atmospheric pressure to approximately $10^{-3}$ Torr, and an ionization gauge 232 is provided to measure pressures in the vacuum vessel volume 207 below $10^{-4}$ Torr.

Inventive Meissner coil 202 and cryopanel 204 each have outer surfaces encased in carbon aerogel. In a preferred embodiment for Meissner coil 202, a series of rings 234 formed from composite carbon aerogel/metal mesh are welded encircling the metal coils 236 of Meissner coil 202. In a preferred embodiment for cryopanel 204, a composite carbon aerogel/metal mesh sheet 238 is welded to the metal surface of cryopanel 204. Rings 234 and sheet 238 are cooled through thermal conduction by their direct contact with the liquid nitrogen-cooled outer surfaces of the Meissner coil 202 and cryopanel 204, and may be heated during regeneration using resistance heating. To effect the resistance heating, leads 240 and 242 may be extended from AC or DC power source 244 through electrical feed through 246 into vacuum vessel volume 207. One lead 240 is connected to one end of Meissner coil 202 and cryopanel 204, while the other lead 242 is connected to the opposing ends of Meissner coil 202 and cryopanel 204. Once power is supplied from power supply 244, current will flow through both the metal surfaces of Meissner coil 202 and cryopanel 204 and the attached metal composite aerogel panels such as rings 234 and sheet 238, resistively heating the metal composite aerogel panels and the metal surfaces of Meissner coil 202 and cryopanel 204.

However, it should be understood that other configurations of carbon aerogel materials may be used, and that the inventive Meissner coil and cryopanel can use any means to secure carbon aerogel panels such as rings 234 and sheet 238 to their outer surfaces which provides good thermal conductivity, including but not limited to bolts, adhesives, and flanges.

While the above descriptions describe the use of the inventive carbon aerogel sorbent with a liquid refrigerant cryosorption pump, a compressed helium cryogenic pump, a cryopanel, and a Meissner coil, it should be understood that the inventive carbon aerogel sorbent could be used in any application for which adsorption of gases onto a sorbent is desired.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A cryogenic pumping system, comprising:

a vacuum environment;

an aerogel sorbent formed from a carbon aerogel disposed within said vacuum environment;

cooling means for cooling said aerogel sorbent sufficiently to adsorb molecules from said vacuum environment onto said aerogel sorbent.

2. The cryogenic pumping system of claim 1, wherein said aerogel sorbent comprises at least one panel of carbon aerogel.

3. The cryogenic pumping system of claim 2, wherein said at least one panel of carbon aerogel has deposited upon a section of a metal mesh or foil.

4. The cryogenic pumping system of claim 2, wherein said at least one panel of carbon aerogel has metallized outer surfaces.

5. A liquid refrigerant cryosorption pump for pumping a pumping environment, comprising:

a liquid refrigerant container;

a quantity of a liquid refrigerant disposed within said liquid refrigerant container;

a vacuum container at least partially immersed in said quantity of liquid refrigerant;

means for detachably fixing said vacuum container to said pumping environment;

an aerogel sorbent formed from a carbon aerogel disposed within said vacuum container.

6. The cryogenic pumping system of claim 5 wherein said liquid refrigerant is liquid nitrogen and said aerogel sorbent is cooled to a temperature of no greater than 80 Kelvin.

7. The liquid refrigerant cryosorption pump of claim 6 wherein said aerogel sorbent is formed in at least one panel, said at least one panel having an edge fixed to said vacuum container.

8. The liquid refrigerant cryosorption pump of claim 6 wherein said vacuum container is cylindrical, wherein said aerogel sorbent forms a plurality of semicircular panels each having a curved edge and a straight edge, and wherein said plurality of semicircular panels are fixed along their curved edges to said vacuum container in opposing pairs such that a gap is left between the straight edges of each said coplanar pair of panels.

9. The liquid refrigerant cryosorption pump of claim 8 wherein said semicircular panels are each deposited upon a section of a metal mesh or foil.

10. The liquid refrigerant cryosorption pump of claim 8 wherein said semicircular panels of carbon aerogel each form outer surfaces which are metallized.

11. A compressed helium cryogenic pump for pumping a pumping environment, comprising:

a vacuum chamber enclosing a vacuum environment;

means for fixing said vacuum chamber to said pumping environment;

a gaseous helium compression means;

a gaseous helium refrigeration means receiving compressed gaseous helium from and returning gaseous helium to said gaseous helium compression means;

a first stage and a second stage disposed within said vacuum environment and cooled by said gaseous helium refrigeration means;

a sorbent array comprising a quantity of a carbon aerogel fixed about said second stage.

12. The cryogenic pumping system of claim 11 wherein said first stage is cooled to between 50 and 80 Kelvin and said second stage cooling chamber is cooled to between 10 and 20 Kelvin.

13. The cryogenic pumping system of claim 12 wherein said sorbent array comprises one or more panels of carbon aerogel each attached along an edge to said second stage.

14. The cryogenic pumping system of claim 13 wherein said at least one panel is deposited upon a section of a metal mesh or foil.

15. The cryogenic pumping system of claim 13 wherein said at least one panel has metallized outer surfaces and can be heated directly by application of electrical current.

16. A cryopanel, comprising:

a body forming a hollow interior and having an outer surface;

a liquid refrigerant disposed within said hollow interior of said body;

an aerogel sorbent formed from a carbon aerogel fixed to said outer surface of said body.

17. The cryopanel of claim 16 wherein said body forms a rectangular panel and said aerogel sorbent forms at least one sheet fixed upon at least one surface of said rectangular panel.

18. The cryopanel of claim 16, wherein said cryopanel is a Meissner coil, said body is coiled, and said aerogel sorbent is formed into a plurality of rings each encircling said outer surface of said coiled body.

* * * * *